US005385625A

United States Patent [19]

LaFreniere

[11] Patent Number: 5,385,625

[45] Date of Patent: Jan. 31, 1995

[54] APPARATUS FOR MANUFACTURING CORRUGATED PALLETS USING A STACKED COMPRESSION STATION

[75] Inventor: Brian R. LaFreniere, Lambertville, N.J.

[73] Assignee: Bay Corrugated Container, Inc., Monroe, Mich.

[21] Appl. No.: 118,399

[22] Filed: Sep. 7, 1993

[51] Int. Cl.[6] ..... B65H 29/00; B65H 31/34

[52] U.S. Cl. ..... 156/379.8; 156/556; 156/562; 156/578

[58] Field of Search ..... 156/539, 559, 562, 578, 156/556, 379.8; 100/137, 194, 196, 207, 155 R; 108/51.3, 52.1

[56] References Cited

U.S. PATENT DOCUMENTS

| | | | |
|---|---|---|---|
| 2,402,492 | 6/1946 | Galber et al. | 156/580 |
| 3,077,271 | 2/1963 | Siempelkamp | 100/196 |
| 3,170,189 | 2/1965 | Hutter | 100/207 |
| 3,513,053 | 5/1970 | Sullivan | 156/562 |
| 3,853,670 | 12/1974 | Cox et al. | 156/562 |
| 4,454,946 | 6/1984 | Yokowo . | |
| 4,487,136 | 12/1984 | Beckway . | |
| 4,543,147 | 9/1985 | Noto et al. | 100/137 |
| 4,565,481 | 1/1986 | Pagnoni | 100/196 |
| 4,714,026 | 12/1987 | Yamaguchi et al. . | |
| 4,799,620 | 1/1989 | Vitella . | |
| 4,857,135 | 8/1989 | Copp | 156/580 |
| 4,898,321 | 2/1990 | Delany . | |
| 4,936,229 | 7/1990 | Parnell . | |
| 5,067,418 | 11/1991 | Carter . | |
| 5,076,176 | 12/1991 | Clasen . | |
| 5,129,329 | 7/1992 | Clasen . | |

*Primary Examiner*—Caleb Weston
*Assistant Examiner*—Richard Crispino
*Attorney, Agent, or Firm*—Brooks & Kushman

[57] ABSTRACT

An apparatus is disclosed for manufacturing corrugated pallets from a base panel of corrugated material, a top panel of corrugated material and a plurality of spacers blocks. Each of the spacer blocks is bonded to the base sheet and top sheet. The apparatus comprises a loading station for receiving the base panel and top panel, and a glue applicator for extruding a plurality of continuous sheets of glue to predetermined areas of the base panel and top panel. An assembly station includes a locating system for receiving and locating the base panels, spacer blocks and top panel in relation to the base panel when the top panel is placed upon a plurality of spacer blocks to form the corrugated pallet. A transfer compression station for applying a continuous initial pressure to the corrugated pallet at the base and top panels of the corrugated pallet while simultaneously transferring the corrugated pallet in a horizontal direction. A final compression station for applying a final glue setting pressure to the corrugated pallet. A conveyor for transferring the base and top panels from the loading station through the glue applicator. The conveyor also transfers the base and top panels from the glue applicator to the assembly station. The compression conveyor transfers the corrugated pallet from the assembly station to the final compression station.

11 Claims, 3 Drawing Sheets

APPARATUS FOR MANUFACTURING CORRUGATED PALLETS USING A STACKED COMPRESSION STATION

This application is related to application Ser. No. 7/980,533 filed Nov. 23, 1992 and entitled "Recyclable cardboard pallet and method of manufacturing recyclable cardboard pallet".

TECHNICAL FIELD

This invention relates to an apparatus for manufacturing pallets, and more particularly to an apparatus and method for manufacturing corrugated cardboard pallets including corrugated cardboard spacers.

BACKGROUND ART

Pallets are used to store and ship a wide variety of materials or products. Conventional pallets are most often fabricated from wood. One problem associated with wooden pallets is that they are a relatively high cost item. Wooden pallets are generally intended to be used more than once and, if damaged, must be repaired to make their use economically viable. Substantial costs are incurred in repairing wood pallets.

It has previously been proposed to include corrugated cardboard or other paper products in pallets. For example, in Yamaguchi et al. U.S. Pat. No. 4,714,026 and Vilella U.S. Pat. No. 4,799,620, combination plastic and paperboard pallets are proposed. However, with these approaches, it is necessary to separate plastic and paperboard products prior to recycling, and again the costs associated with wood and plastic is relatively high compared to corrugated cardboard.

Clasen U.S. Pat. No. 5,076,176 discloses a corrugated cardboard pallet comprising cardboard sheets separated by a stacked, corrugated cardboard spacers. This approach, while offering an entirely corrugated cardboard construction, suffers from the disadvantage of being unduly expensive because forming a solid stack of corrugated cardboard requires a large quantity of corrugated cardboard which is then glued together to form the spacer blocks.

Applicant's invention is directed to solving the above problems by providing a machine which will reduce the cost associated with making corrugated cardboard pallets.

Important objects and advantages achieved by applicant's invention are summarized below.

SUMMARY OF THE INVENTION

It is an object of the present invention to provide an apparatus for manufacturing a low cost corrugated cardboard pallet.

It is another object of the invention to provide an apparatus for manufacturing a corrugated cardboard pallet which uses only a minimum amount of cardboard while producing a relatively strong, lightweight pallet.

It is also an object of the invention to provide an apparatus for manufacturing a corrugated cardboard pallet which produces pallets within a short period time.

A further object of the invention is to provide an apparatus for manufacturing a corrugated cardboard pallet which includes a minimum amount of manual operations.

It is more specific object of the invention to provide an apparatus for manufacturing a corrugated pallet comprising a loading station for receiving a base panel and top panel, a glue applicator for extruding a plurality of continuous sheets of glue to predetermined areas of the base panel and top panel. An assembly station is provided including a locating system for initially locating the base panel and further locating the top panel in relation to the base panel when said top panel is placed upon a plurality of spacer blocks to form the corrugated pallet.

A transfer compression station is provided for applying a continuous initial pressure to the corrugated pallet at the base and top panels of the corrugated pallet while simultaneously transferring the corrugated pallet in a horizontal direction. An elevator and stacker are disposed adjacent the transfer compression stations for stacking the pallets in a vertical column.

A stacked compression station is provided for applying a final glue setting pressure to the vertical columns of corrugated pallets at the base and top panels. A conveyor is also provided for transferring the base and top panels from the loading station through the glue applicator and further transferring the base and top panels from the glue applicator to the assembly station.

According to another aspect of the present invention, a method of manufacturing a corrugated cardboard pallet is provided. The method includes providing a base panel of corrugated material and a top panel of corrugated material and providing a plurality of spacers blocks having a first side and second side. Extruded sheets of glue are applied to predetermined areas of both the base panel and top panel.

The spacer blocks are placed on the predetermined areas of the base panel such that the first side of the spacer blocks are substantially contacting the extruded glue sheets on the base panel. The top panel is next located in relation to the base panel such that the predetermined areas of the top panel contact the second side of the spacer blocks and the spacer blocks are substantially contacting the extruded glue sheet on the top panel. A continuous initial pressure is first applied to the corrugated pallet at the base and top panels for squaring off the spacer blocks in relation to the top and base panel. A final glue setting pressure is next applied to the corrugated pallet at the base and top panels.

The above objects, features and advantages of the present invention, as well as others, are readily apparent from the foregoing detailed description of the invention in view of the drawings.

BEST MODE FOR CARRYING OUT THE INVENTION

Figure 1:
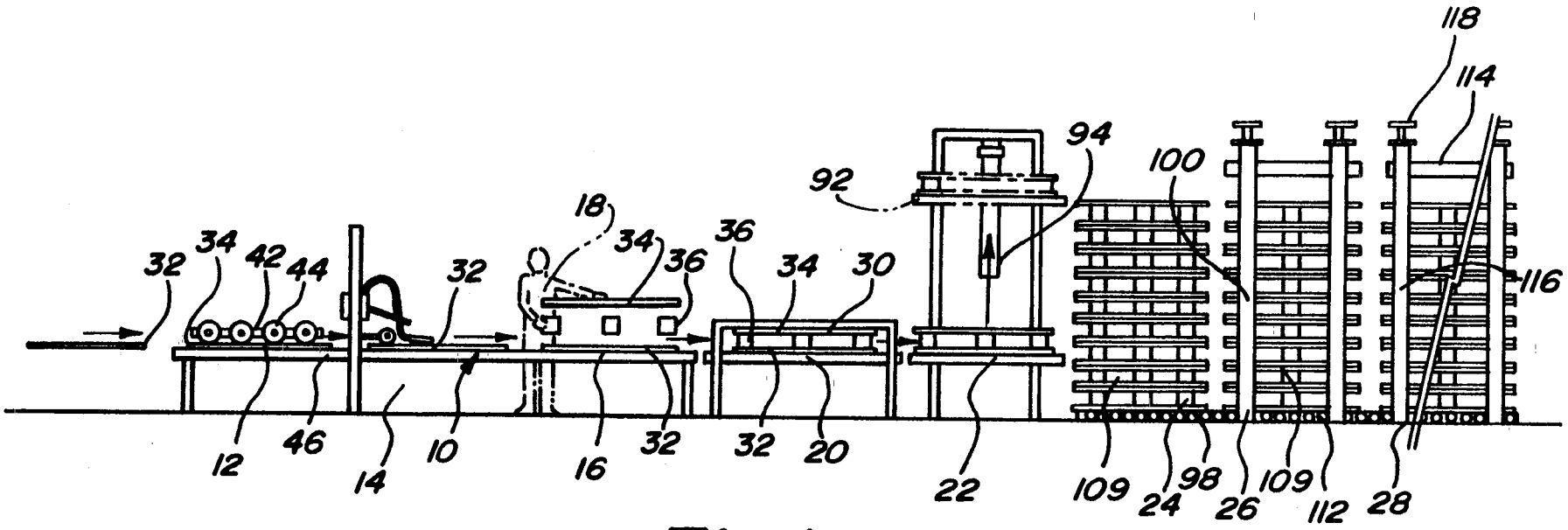
FIG. 1 is a schematic side view of an apparatus for manufacturing pallets constructed in accordance with the present invention.

Referring now to FIG. 1, there is shown the apparatus for manufacturing corrugated pallets of the present invention generally indicated at 10. A loading station 12 is shown directly adjacent the glue application station 14. Manual assembly station 16 is shown with an assembly operator 18. A transfer compression station 20 is illustrated adjacent the assembly station 16.

Elevator 22 is shown next to stacking station 24. An intermediate compression station 26 is illustrated adjacent final, multiple compression station 28. Glue station 14, assembly station 16, transfer compression station 20 and final compression station 28 are each shown in more detail in FIGS. 2 through 5 respectively.

An assembled corrugated pallet 30 is shown also shown in FIG. 1. The pallet 30 includes a base panel of corrugated material 32 and a top panel of corrugated material 34. A plurality of spacer blocks 36 is shown disposed between base panel 32 and top panel 34. Prior to describing the manufacturing apparatus of the present invention in detail, attention is briefly turned to a discussion of the assembly of the corrugated pallet to facilitate a better understanding of the various elements of the apparatus.

Figure 3:
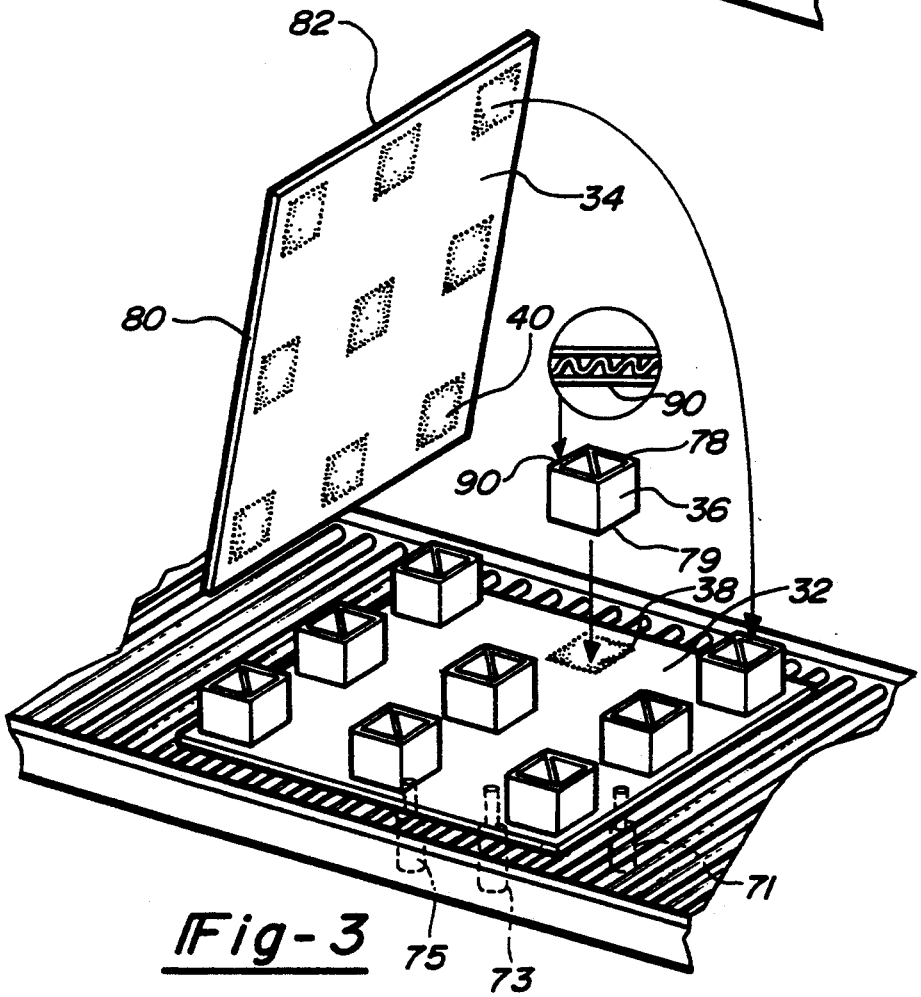
FIG. 3 is a fragmentary, perspective view of the pallet assembly station of the present invention.

Referring now to FIG. 3, the corrugated pallet 30 is shown including nine spacer blocks 36 spaced at predetermined locations on base panel 32. A plurality of extruded sheets of glue is shown on base panel 32 which coincides with the predetermined locations of the spacer blocks. Correspondingly, a plurality of extruded sheets of glue 40 are shown disposed on top panel 34. In this manner a corrugated pallet is provided having a base panel 32 bonded to a plurality of spacer blocks 36 which are in turn bonded to a top panel 34. Further description of the corrugated cardboard pallet is disclosed in patent application Ser. No. 7/980,533 filed Nov. 23, 1992 and entitled "Recyclable Cardboard Pallet and Method of Manufacturing Recyclable Cardboard Pallet" incorporated herein by reference.

Referring FIG. 1, loading station 12 is shown receiving a top panel 34. In accordance with the present invention, the top panel 34 and base panel 32 are loaded into the loading station 12 alternately. There may be slight dimensional differences between the base panel and top panel. Some pallets are designed with differences in side-to-side lengths of up to four inches. In addition, the bottom panel may include cutouts for handjacks. The loading station 12 is designed to accept panels with these slight differences.

An idler arm 42 is shown in FIG. 1 having a plurality of idler wheels 44. The idler arm 42 is used to increase the downward pressure on the top and base panels entering the apparatus to increase the panel transferring capabilities of the conveyor 46.

Conveyor 46 is used for transferring both the unassembled pallets elements, top and base panels 32 and 34, and also transferring the assembled pallet from the loading station through the intermediate stations and to the elevator 22. As in FIGS. 2 through 4, the conveyor 46 is a conventional line conveyor such as a belt-driven accumulation conveyor used for light articles including an elongate drive shaft 48 and a plurality of independently driven rollers 50 supported by a frame 52. Each individual roller is driven via a belt (not shown), which is in turn driven by the rotating drive shaft 48.

Figure 2:
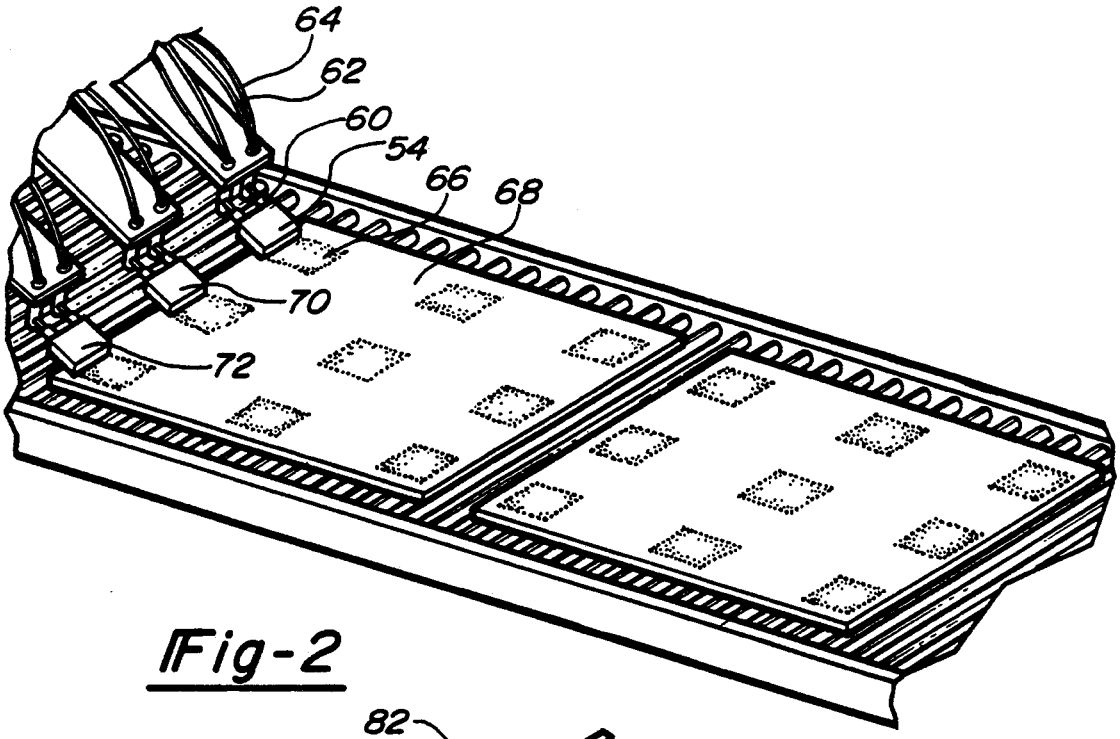
FIG. 2 is a fragmentary, perspective view of a glue station and roller conveyor in accordance with the present invention.
Figure 6:
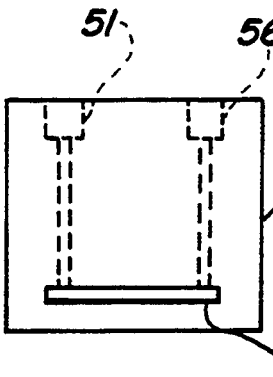
FIG. 6 is a bottom elevational view of the glue head of the present invention.

Referring now to FIGS. 2 and 6, there is shown the glue application station of the present invention. Glue head 54 has a pair of glue aperture 56 and 57 in fluid communication with an extending extrusion slit 58. Glue extrusion slit 58 has a width of approximately 0.035 inches. A pair of glue actuation valves 60 are connected to each glue head 54 at glue apertures 56 and 57. Glue actuation valve is also connected to a glue supply line 62 and a shop air supply line 64.

Glue supply line 62 is connected to a glue supply (not shown). Glue supply line 62 is pressurized to provide glue to the glue head 54 at glue actuation valve 60. Glue actuation valve has an open position and closed position, actuable by a predetermined amount of pressurized air supplied to the glue actuation valve 60. Thus in operation, pressurized glue is provided to glue actuation valve 60 where it is stopped, upon actuation by a specified amount of air from shop air supply line 64, glue actuation valve 60 moves to the open position. In the open position, glue under pressure from glue supply line 62 enters glue apertures 56 and 57 and then proceeds to glue extrusion slit 58.

A rectangular substantially continuous sheet of glue 66 is provided to the moving panel 68. While some gaps or voids may be present in the sheet of glue as a result of production conditions, a full sheet of glue is preferred. Different patterns or lengths of glue sheets can be achieved for different spacer block sizes by varying the time between actuation of the glue actuation valve thereby controlling the amount of glue exit from the glue head.

The operation of glue heads 70 and 72 is identical to that of glue head 54. Glue heads 54, 70 and 72 are manufactured from a UHMW (Ultra High Molecular Weight) plastic to afford relatively little friction between the glue heads and the moving panels 32 and 34. It is preferred that a UHMW plastic is used. However, it is anticipated that Polytetrafluorethylene material with a low coefficient of friction would also be acceptable.

The glue used with the present invention is a cold extrusion glue or flexo-glue which is conventionally known in the art. The glue is preferably a repulpable glue to facilitate recycling. The preferred embodiment requires a commercially available cold extrusion glue known as glue "3673-2" provided by Ajax Adhesives Industries Inc. of Chicago Ill.

Referring back to FIG. 1, assembly station 20 next receives the base panel including the plurality of glue segments 66. Assembly station 20 includes at least two retractable locating rods 71 and 73. Locating rod 71 serves a dual purpose, rod 71, when extended above the height of the conveyor 46 acts as positive stop for retaining the base panel 32 at the assembly station 20. Rod 71, when used in conjunction with rod 73 located adjacent rod 71, acts a locating device for locating top panel 34 in relation to bottom panel 32. The preferred embodiment uses three actuated rods 71, 73 and 75 disposed as illustrated in FIG. 3. Thus, rods 71, 73 and 75 act as a locating means for initially locating the base panel 32 on the conveyor and also locating the top panel 34 in relation to the base panel 32.

As top panel 34 is placed on the exposed sides 78 of the plurality of spacer blocks 36, it is, as disclosed above, necessary to align the top panel 34 in relation to the bottom panel 32. Rods 71 and 73 are disposed in a 90 degree relationship corresponding to the corner dimensions of both the base panel and the top panel. With the use of rods 71, 73 and 75, the operator can manually place the top panel 34 on the blocks until sides 80 and 82 engage the rods. The rods 71, 73 and 75 are actuated by regulated pneumatic cylinders.

Figure 4:
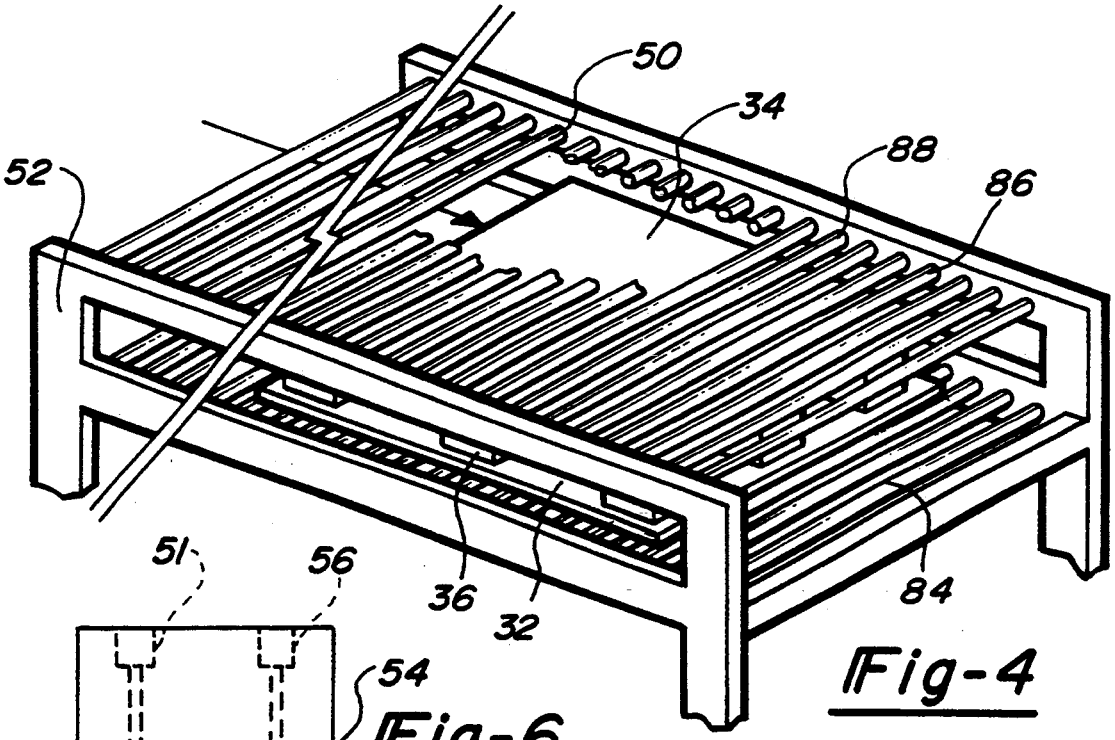
FIG. 4 is fragmentary, perspective view of the transfer compression conveyor of the present invention.

Referring now to FIG. 4, transfer compression station 20 includes a driven section of conveyor 84 and a free rolling section of conveyor 86. As described above, driven section 84 is simply a part of overall conveyor 46. Free rolling section 86 is located directly above the driven section 84. Free rolling section 86 is further located above the driven section at a height which is slightly less than the assembled height of the corrugated pallet.

The height must be sufficient to allow the corrugated pallet to travel transversely between the conveyors section 84 and 86 while still allowing an abutting engagement of the top panel 34 with the individual rollers 88 of the free rolling section. In the preferred embodiment, this height is 0.125 inches less than the assembled height of the corrugated pallet as the pallet leaves the assembly station 20.

Referring to FIGS. 3 and 4, transfer compression station 20 operates to initially apply pressure to the top and bottom panels 32 and 34 of the corrugated pallet to square off the spacer blocks 36. More specifically, the transfer compression station 20 orients the top and bottom panels in a vertical direction and squeezes any excess glue that remains between the sides 78 and 79 of the spacer blocks. In addition this initial compression acts to fully engage and coat the flute sections 90 (shown in an elongated view in FIG. 3) with the glue segments 66.

Referring now to FIG. 1, elevator 22 is shown transferring a pallet in both horizontal and vertical directions. Elevator 22 transfers corrugated pallets from the transfer compression station 20 to the stacker 24. Elevator 22 includes a lift platform 92 driven in a vertical direction by a ball screw 94. Ball screw 94 includes a multiple pre-set speed gear motor with encoder feedback to give the absolute position of the predetermined dimensional heights of each stacked corrugated pallet. The platform is movable between a first height representing the highest level required to stack the corrugated pallets and a second height representing the height of the transfer compression station 20.

The lift platform 92 includes a pallet conveyor 96. Pallet conveyor 96 has a plurality of elongate bands 98 supported on a pair of axles 100 and 102. Axle 102 is driven by a gear motor. Pallet conveyor 96 transfers corrugated pallets from the transfer compression station 20 by picking the pallet from the conveyor in a horizontal direction through the use of pallet conveyor 96. The elevator 22 then transfers the pallet 30 first in a vertical direction, and then in a horizontal direction to the stacking station 24, again through the use of the pallet conveyor 96.

Stacking station 24 receives corrugated pallets that are stacked in an upward vertical direction, one on top of another, as shown in FIG. 1. Stacking station 24 further includes a driven pallet conveyor 98 for transferring the vertical stack or column to an intermediate compression station 26.

Figure 5:
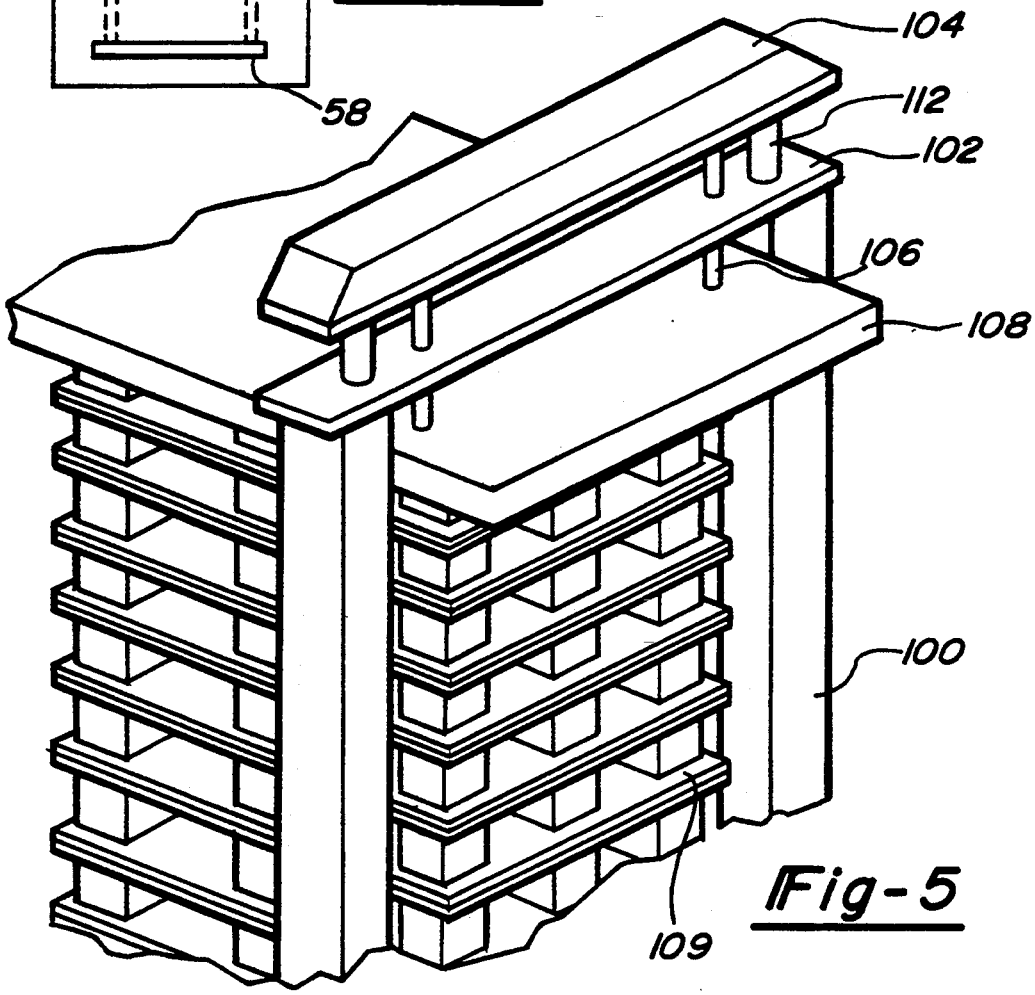
FIG. 5 is fragmentary, perspective view of the final compression station of the present invention.

Referring to FIGS. 1 and 5, intermediate compression station 26 has a pair of U-shaped support members 100, (only one is shown). Support member 100 has a transverse portion 102. A transfer bar 104 is disposed above the transverse-portion 102. Transfer bar 104 includes a pair of connecting rods 106 affixed to a compression plate 108. Connecting rods 108 are slidably received within a pair of corresponding locating bores 110.

A pair of air springs 112 are operably affixed to the transfer bar 104 and the transverse segment 102. The air springs 112, when fully actuated, move the transfer bar 104 away from the transverse bar in a vertical direction. The movement of the transfer bar 104 in turn raises and lowers the compression plate 108.

Compression plate 108 is used to apply a continuous pressure to the vertical column of pallets 109. The compression plate of the intermediate compression station applies approximately 3 minutes of compression to the top pallet. The compression force is evenly distributed throughout the entire vertical column by virtue of the stacked relationship of the pallets. The approximate compression pressure is equal to the weight of gravity associated with the compression plate and is therefore modified by using compression plates of different thicknesses or added weight to the compression plate. The preferred compression pressure for the intermediate compression station is approximately 10.4 lbs./sq in. The compression plate therefore is approximately 250 lbs and encompasses approximately 24 square feet.

A final compression station 28 is shown in FIG. 1 adjacent intermediate compression station 26. Final compression station 28 operates in substantially the same manner as intermediate compression station 26. As such, FIG. 5 is also illustrative of the operation of final compression station 28.

Intermediate compression station 26 includes a roller conveyor 112 which extends below the vertical column of corrugated pallets and extends from the intermediate compression station to the end of the final compression station 28. After application of pressure in the intermediate station, the vertical column is transferred via the conveyor 112 to final compression station 28. Final compression station 28 includes a compression plate with a length substantially longer than that of compression plate 108 of the intermediate compression station 26. Compression plate 114 of final compression station 28 is approximately 30 feet long and capable of enclosing approximately 10 vertical columns of corrugated pallets. In the final compression, operation, a vertical column with corrugated pallets is indexed one at a time into final compression station 28 in a "first-in, last-out" method. As such, a new vertical column of corrugated pallets is indexed into the final compression station every three minutes and continues to receive compression pressure until the next indexed vertical column is received into the final compression station. Pressure is then applied again and the process proceeds in this fashion until the column is indexed out of the final compression station.

Each individual vertical column of corrugated pallets receives approximately thirty minutes of final compression pressure in the final compression station. In the preferred embodiment, final compression station 28 is capable of receiving 10 vertical columns. Conveyor 112 moves each individual vertical column through the final compression station to an exit position at the end of the final pallet compression station 28.

Having described the mechanical operation of the apparatus of the present invention, a method of manufacturing corrugated pallets is also provided. The method includes the steps of providing a base and top panel of corrugated material, providing a plurality of spacer blocks having a first side and a second side, and extruding a sheet of glue to predetermined areas on the base and top panels. Next, the plurality of spacer blocks is placed on the base panel, where the first side of the spacer blocks is substantially contacting an extruded glue sheet on the base panel. The top panel is next located in relation to the base panel such that the predetermined areas of the top panel contact the second side of the spacer blocks and is further substantially contacting the extruded glue surfaces on the top panel. When the glue cures top and bottom walls of the spacer are essentially formed by the solidified glue. A continuous initial pressure is applied to the corrugated pallet at the base and top panels to square off the spacer blocks in relation to the top and base panels. Finally, a final glue setting pressure is applied to the corrugated pallet at the base and top panels.

While the best mode for carrying out the invention has been described in detail, those familiar with the art to which this invention relates will recognize alternative designs and embodiments for practicing the invention as defined by the following claims.

What is claimed is:

1. An apparatus for manufacturing a plurality of corrugated pallets, said pallets having a base panel of corrugated material, a top panel of corrugated material and a plurality of spacer blocks disposed therebetween, wherein each of said spacer blocks is bonded to said base panel and top panel, said apparatus comprising:

a loading station for receiving base panels and top panels;

a glue applicator for extending a plurality of continuous sheets of glue to predetermined areas of said base panels and top panels;

an assembly station for assembling a pallet from said panels and blocks including a locating system for receiving and locating a base panel in relation to a top panel;

a transfer compression station for applying initial pressure to each of said corrugated pallets individually while simultaneously transferring pallets individually in a horizontal direction;

a stacking means to stack a plurality of said corrugated pallets in a vertical column;

a stacked compression station for receiving a plurality of said vertical columns and for applying pressure to said plurality of vertical columns of said corrugated pallets;

conveying means for transferring said base panels from said loading station through said glue applicator to said assembly station, said conveying means further transferring said base and top panels from said assembly station to said transfer compression station, wherein said transfer compression station transfers said corrugated pallets to said stacking means;

said conveying means further comprising means to transfer the vertical columns of corrugated pallets.

2. An apparatus as in claim 1, said stacking means further comprising:

an elevator disposed adjacent said transfer compression station, said elevator adapted to receive said corrugated pallet and move said pallet in both a vertical and horizontal direction to form a vertical column of corrugated pallets;

a stacking station for receiving said corrugated pallet and forming said vertical column, said stacking station adapted to transfer said vertical column to said stacked compression station.

3. An apparatus as in claim 2 further comprising:

an intermediate compression station disposed between said stacking station and a final compression station for providing a compression force on said vertical column.

4. An apparatus as in claim 2 wherein said elevator further comprises a lift platform, said platform indexable in a range of positions between a first height and a second height, said platform having a pallet transfer conveyor including a plurality of elongate band members supported on a pair of axles, at least one axle being driven, thereby moving said band members in a corresponding direction.

5. An apparatus as in claim 2 wherein said transfer compression station comprises:

a first driven section of conveyor for moving said corrugated pallet horizontally from said assembly station to said elevator;

a second free rolling section of conveyor disposed directly above said first section of conveyor, said second rolling section located at a height sufficient to abuttingly engage said corrugated pallet when said pallet moves between said first and second conveyor sections.

6. An apparatus as in claim 1 wherein said glue applicator comprises:

a glue head having a glue supply aperture in fluid communication with an extrusion slit;

a glue actuation valve connected to said glue head and in fluid communication with said glue supply aperture, said glue actuation valve having an open position and a closed position;

a pressurized cold extrusion glue supply connected to said glue actuation valve; and a regulated air supply connected to said glue actuation valve, wherein application of a predetermined amount of pressurized air actuates said glue valve to the open position thereby allowing said glue supply to pass through said glue actuation valve and enter said glue supply aperture and exit said extrusion slit.

7. An apparatus as in claim 1 wherein said stacked compression station comprises:

a first "U" shaped support member having a transverse segment and a transfer bar connected to said transverse segment, said transfer bar movable in relation to said transverse segment, said first "U" shaped support member defining a first open space below said transverse segment;

a second "U" shaped support member spaced from said first "U" shaped support member, said second "U" shaped member having a transverse segment and a transfer bar movable in relation to said second "U" shaped member transverse segment, said second "U" shaped support member defining a second open space below said transverse member a compression plate having a first end and a second end, said first end disposed below said first support member transverse segment in said first open space and said second end disposed directly below said second support member transverse segment in said second open space, said compression plate thereby extending from said first support member to said second support member;

a first connecting rod extending from said first support member transfer bar and affixed to said first end of said compression plate;

a second connecting rod extending from said second support member transfer bar and affixed to said second end of said compression plate;

a first pair of air springs affixed between said first support member transverse segment and said first support member transfer bar, said air springs adapted to move said transfer bar away from said transverse segment;

a second pair of air springs affixed between said second support member transverse segment and said second support member transfer bar, said air springs adapted to move said transfer bar away from said transverse segment, wherein simultaneous actuation of said first and second air springs moves said compression plate in relation to said first and second "U" shaped support members.

8. An apparatus as in claim 7 further comprising:

a driven conveyor assembly disposed below said first and second "U" shaped members for transferring said corrugated pallets in a horizontal direction.

9. An apparatus for manufacturing corrugated pallets, said pallets having a base panel of corrugated material, a top panel of corrugated material and a plurality of spacer blocks disposed therebetween, wherein each of said spacer blocks is bonded to said base panel and top panel, said apparatus comprising:

applicator means for applying a continuous sheet of glue to predetermined areas of said base panel and top panel;

said apparatus including a supply of spacer blocks adjacent said applicator means, said blocks adapted for manual assembly thereof onto the predetermined areas of said base panels;

locator means for locating said top panel in relation to said base panel when said top panel is placed upon said plurality of spacer blocks to form said corrugated pallet;

first compression means for applying an initial pressure to said corrugated pallet, said first compression means applying a sufficient pressure to square off said spacer blocks in relation to said top and bottom panels while simultaneously transferring said corrugated pallet in a horizontal direction;

stacking means to stack a plurality of said corrugated pallets in a vertical column; and second compression means for receiving a plurality of said vertical columns and for applying pressure to said plurality of vertical columns of said corrugated pallets for a period of time sufficient to allow the glue to set.

10. An apparatus as in claim 9 further comprising conveyor means for moving said base and top panels through said applicator means to said locating means and from locating means through said assembly means to said first compression means.

11. An apparatus as in claim 10 wherein said conveyor means includes a plurality of rollers, each of said rollers being simultaneously driven by a drive belt connected to a primary extending drive shaft.

* * * * *